US012398912B1

(12) United States Patent
Edwards

(10) Patent No.: US 12,398,912 B1
(45) Date of Patent: Aug. 26, 2025

(54) EXTERIOR WALL PORT FOR PORTABLE AIR CONDITIONING UNITS

(71) Applicant: Rod Edwards, Carmichael, CA (US)

(72) Inventor: Rod Edwards, Carmichael, CA (US)

( * ) Notice: Subject to any disclaimer, the term of this patent is extended or adjusted under 35 U.S.C. 154(b) by 0 days.

(21) Appl. No.: 18/821,706

(22) Filed: Aug. 30, 2024

(51) Int. Cl.

| | |
|---|---|
| ***F24F 13/02*** | (2006.01) |
| ***E04F 17/04*** | (2006.01) |
| ***F24F 1/028*** | (2019.01) |
| ***F24F 13/10*** | (2006.01) |
| *F24F 1/04* | (2011.01) |

(52) U.S. Cl.
CPC ..... *F24F 13/0227* (2013.01); *E04F 17/04* (2013.01); *F24F 1/028* (2019.02); *F24F 13/0209* (2013.01); *F24F 13/10* (2013.01); *F24F 1/04* (2013.01)

(58) Field of Classification Search
CPC .... F24F 13/0227; F24F 13/0209; F24F 13/10; F24F 1/028; F24F 1/04; E04F 17/04
USPC ..... 454/254
See application file for complete search history.

(56) References Cited

U.S. PATENT DOCUMENTS 6,969,799 B2 * 11/2005 Snyder ..... H02G 3/22 52/220.8
9,091,377 B2 * 7/2015 Lechuga ..... F16L 13/141
9,651,174 B2 * 5/2017 Lechuga ..... F16L 21/03
9,989,268 B1 * 6/2018 Spanger ..... F24F 1/0007
11,221,092 B2 * 1/2022 Navon ..... H02G 3/22
2010/0269943 A1 * 10/2010 Arai ..... F16L 5/00 52/220.8
2013/0137360 A1 * 5/2013 Zhong ..... F24F 13/0209 454/341
2014/0352344 A1 * 12/2014 Guercio ..... F24F 13/222 62/499

* cited by examiner

*Primary Examiner* — Avinash A Savani
*Assistant Examiner* — Dana K Tighe
(74) *Attorney, Agent, or Firm* — Michelle C. Lau

(57) ABSTRACT

The present invention is an exterior wall port that provides a secure pathway through a building wall to support a vent hose of a portable air conditioning unit, enabling exhaust air from the unit to be discharged to the outside or intake of fresh air to be drawn into the unit. The exterior wall port comprises a sleeve of components that extends through any desired wall thickness, coupled at the outer side of the wall to a louvered cover plate or a vent cap with a hinged flap, both elements configured to redirect rain and condensation. The opposite end of the sleeve connects to a hose adapter to fit various sized hoses or capped flush with the wall. The interior components are threaded or pressure-fitted to provide a secure connection, with the end components using threading, snapping, and twist lock and ratchet closures to facilitate a secure interchange of components.

20 Claims, 16 Drawing Sheets

EXTERIOR WALL PORT FOR PORTABLE AIR CONDITIONING UNITS

FIELD OF THE INVENTION

The present invention generally relates to ducting arrangements for more efficient control of air conditioning systems. More specifically, the present invention relates to conduit devices positionable in an exterior wall of a building. Such devices are needed to provide a securely sealed pathway therewithin for efficient airflow and operation of a portable air conditioning unit.

BACKGROUND OF THE INVENTION

Portable air conditioning units offer a range of environmental benefits and energy efficiencies that make them an attractive alternative to central air conditioning systems, which come with significant energy demands and environmental impacts. Portable air conditioning units provide a more flexible, targeted, and often more sustainable cooling solution. The environmental advantages and energy efficiencies of portable air conditioners have created an increasing demand for such portable units over traditional central air conditioning systems.

One of the primary environmental benefits of portable air conditioning units lies in their ability to provide targeted cooling. Central air conditioning systems are designed to cool entire buildings or large sections of buildings, leading to an over-expenditure of energy as unoccupied rooms are cooled unnecessarily. Portable air conditioners, in contrast, allow for targeted cooling in specific rooms, resulting in substantial energy savings as less power is required to cool a smaller space. Additionally, portable air conditioners are less energy-intensive than central systems. They typically have a shorter run time to cool a smaller area and hence use less electricity, which not only reduces energy bills but also lowers the overall carbon footprint. This is a primary concern during peak summer months when electricity demand is high and the strain on the power grid can lead to increased reliance on fossil fuels. Using a portable unit reduces individual contribution to this demand, decreasing the environmental impact of energy production.

Another environmental benefit of a portable air conditioning unit over a central system involves the use of refrigerants, which create potent greenhouse gases if leaked into the atmosphere. Although modern central systems use refrigerants with lower global warming potentials than older models, the large volume of refrigerant required for a central system nonetheless poses a significant environmental risk. Portable air conditioners, by comparison, require much less refrigerant due to their smaller size. This reduction in refrigerant use translates directly to lower potential greenhouse gas emissions, particularly in cases of leaks and improper disposal. The shorter operational time for a portable unit also decreases the risk of refrigerant leakage and minimizes the overall environmental impact.

Systems for providing air conditioning to residential and commercial buildings have traditionally been variations of central air conditioning systems for cooling the entire building and window/wall units for cooling individual rooms. However, in recent years, portable air conditioning units have grown in popularity due to a gradual advancement of portable unit technology as well as improved consumer access and a lower cost of equipment and of operation. Opting for a window or wall unit over a central system is typically based on lower cost of installation and desire for efficiency in targeted room cooling. Notwithstanding, the glaring disadvantage in this option is that selection of window and wall units is often limited by sizing and viable placement of the unit. As such, portable air conditioning units have become a more attractive preference to the bulky, obtrusive window and wall units.

Portable air conditioning units are compact, self-contained cooling devices designed to be easily moved from one location to another for use in a specific room or when modifying infrastructure to support window or wall units or central cooling systems is not desirable or not possible. Portable units operate by drawing in warm air from the room or from the outside, cooling it through a refrigeration cycle, and then expelling the cooled air back into the space. This process also generates warm air that must be vented outside.

Proper venting is critical for effective operation and overall efficiency of a portable air conditioning unit. The warm air generated during the cooling process must be discharged outside of the room to prevent it from counteracting the cooling effect. Without proper venting, the warm air would require the air conditioner to work harder and less efficiently, which would lead to reduced cooling performance and higher energy consumption. Venting essentially enables the unit to achieve a consistent and comfortable indoor temperature by continuously removing the exhaust heat created during the cooling process.

Most portable units come with a vent hose to direct and discharge the warm exhaust air in order to achieve proper cooling of a room. Some units also come with an additional intake hose to draw in fresh air from the outside. Dual-hose portable units have balanced air intake and exhaust that enable more effective management of indoor air pressure. Hence, these units can achieve higher airflow while expending less energy, resulting in better energy efficiency.

Hoses are often placed through windows, sliding doors, walls, and ceilings, which are cause for concern due to the lack of sealing at the pathway around the hose. Structures that are left open to allow for placement of the hoses and pathways that are not sealed properly create additional challenges to cooling a room. Consequently, there is a pressing need for creating a secure pathway from a portable air conditioning unit through an exterior wall to enable efficient operation and increased energy efficiency.

SUMMARY OF THE INVENTION

The present invention is an exterior wall port for portable air conditioning units that provides a secure pathway through an exterior wall of a building to support a vent hose of a portable air conditioning unit. The exterior wall port enables both the exhaust air from the unit to be discharged to the outside of the building and an intake of fresh air to be drawn into the unit from the outside environment. The present invention comprises a sleeve of hollow cylindrical components that can be coupled together to expand through any desired wall thickness. The sleeve components are made up of inner sleeves and outer sleeves that connect to each other to form a solid pathway through the building wall. The inner sleeves have external threading on the ends, and the outer sleeves have internal threading. The sleeves can also be smooth with no threading, and pressure-fitted together to form the connection, with optional clamping or adhesive to secure the connections.

The end of the sleeve toward the exterior side of the building wall is coupled to an exterior port fitting that has a groove across the top to allow for moisture drainage. The coupling element on the side of the port fitting that is connected to the sleeve comprises threading or is bare for pressure-fitting. The opposite side comprises a twist lock configuration to coincide with the connecting components, either a louvered cover plate or an exterior vent cap with a hinged flap. The louvered cover plate has the louvers running horizontally to direct rain and moisture away from the vent, and a mesh grid on the backside that protects against debris and insects entering the wall port. The vent cap has a hinged flap that pivots to an open and closed position to allow for discharge of the exhaust air to the outside or intake of fresh air from the outside. The vent cap has an integral downward-sloped hood near the top of the cap and a drain guard near the bottom of the cap that are configured to direct rain and moisture away from the wall port. There is also a weep hole at the bottom of the cap for drainage. Both the louvered cover plate and the exterior vent cap have twist lock grooves that enable a secure closure with the twist lock protrusions of the exterior port fitting.

The opposite end of the sleeve toward the interior side of the building wall connects to an interior port fitting. The coupling element on the side of the port fitting that is connected to the sleeve comprises threading or is bare for pressure-fitting. The opposite side comprises a twist lock configuration to coincide with the connecting components, either an interior hose adapter or an interior vent cap. The interior hose adapter can be attached to hoses of portable air conditioning units and alternatively fitted with a sizing adapter to modify connection for various sized hoses. The hose adapter can be used for both an exhaust hose and an intake hose. When the portable air conditioner is not in use, the wall port can be covered by an interior port cap that is flush with the wall. Both the interior hose adapter and the interior vent cap have twist lock grooves that enable a secure closure with the twist lock protrusions of the interior port fitting.

The components of the present invention are coupled to provide a secure connection within the pathway, with the interior components using threading or pressure-fittings and the end components using threading, snapping, and twist lock and ratchet closures to facilitate an interchange of components.

DESCRIPTION

Figure 1:
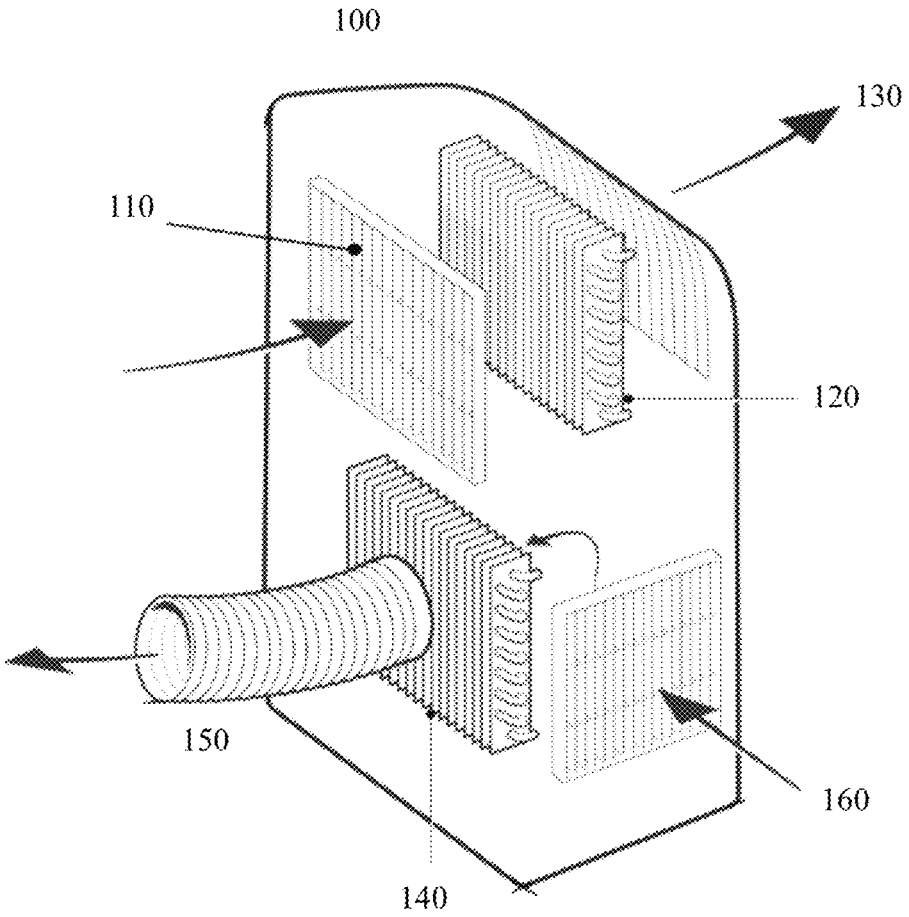
FIG. 1 illustrates a single-hose commercially available portable air conditioning unit.
Figure 2:
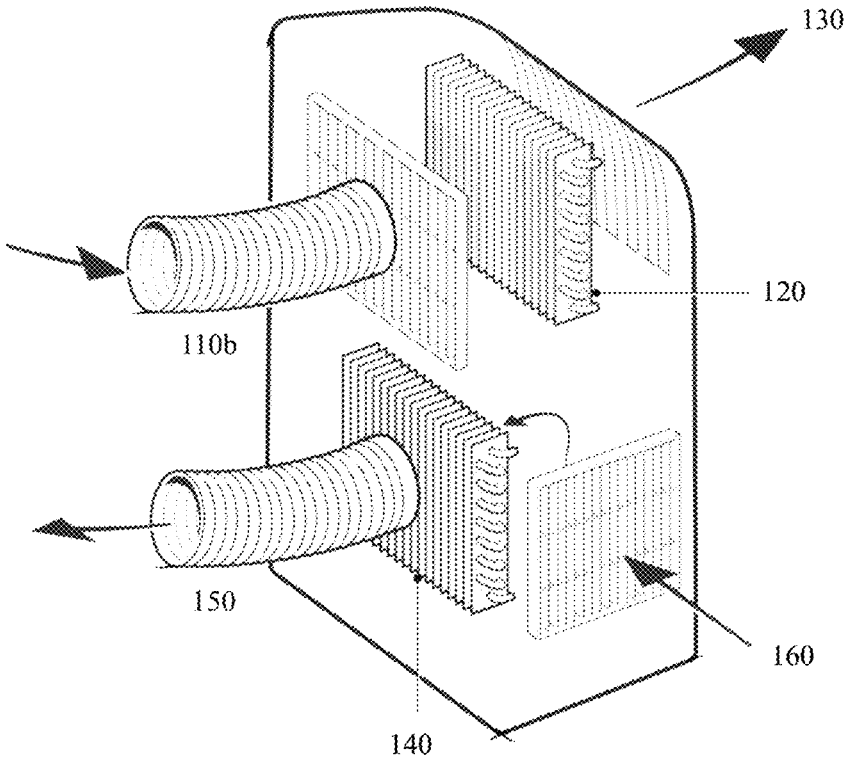
FIG. 2 illustrates a dual-hose portable air conditioning unit.

The present invention is an exterior wall port for portable air conditioning units that provides a secure pathway through an exterior wall to support a vent hose of a portable air conditioning unit, enabling the exhaust air from the unit to be discharged to the outside of the building. FIG. 1 illustrates a typical commercially available portable air conditioning unit 100 (see air flow shown by directional arrows, FIG. 1). Indoor air is drawn in through an intake 110 and cooled by an evaporator coil 120. The cooled air is then expelled out of the unit (see 130) and into the room. Hot air is released by a condenser coil 140 into the surrounding environment or directed through a vent hose 150. Cold indoor air drawn in through a separate intake 160 is used to cool the condenser coil 140. Some units are also equipped with a second hose used for air intake. These dual-hose units are more efficient because they eliminate negative pressure problems by balancing air intake and air exhaust. FIG. 2 illustrates a typical dual-hose unit 100*b*, where indoor air is drawn in through an intake hose 110*b* and cooled by an evaporator coil 120. The cooled air is then expelled out of the unit (see 130) and into the room. Hot air is released by a condenser coil 140 into the surrounding environment or directed through a vent hose 150. Cold indoor air may also be drawn in through a separate intake 160 and used to cool the condenser coil 140. Although the vent hoses of portable units may be directed out a nearby window or door, it is counterproductive to have an open window or poorly sealed pathway through which warm air may enter the room and cold air may escape.

Figure 3:
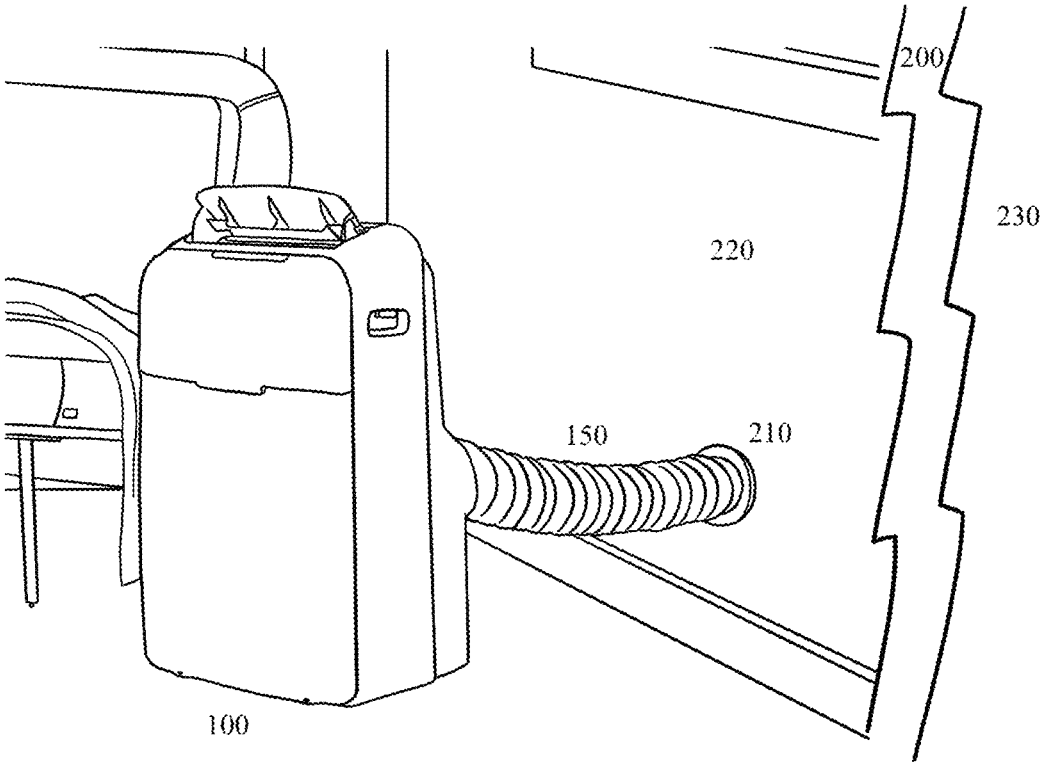
FIG. 3 illustrates the functionality of the exterior wall port connected to a single-hose portable air conditioning unit.
Figure 4:
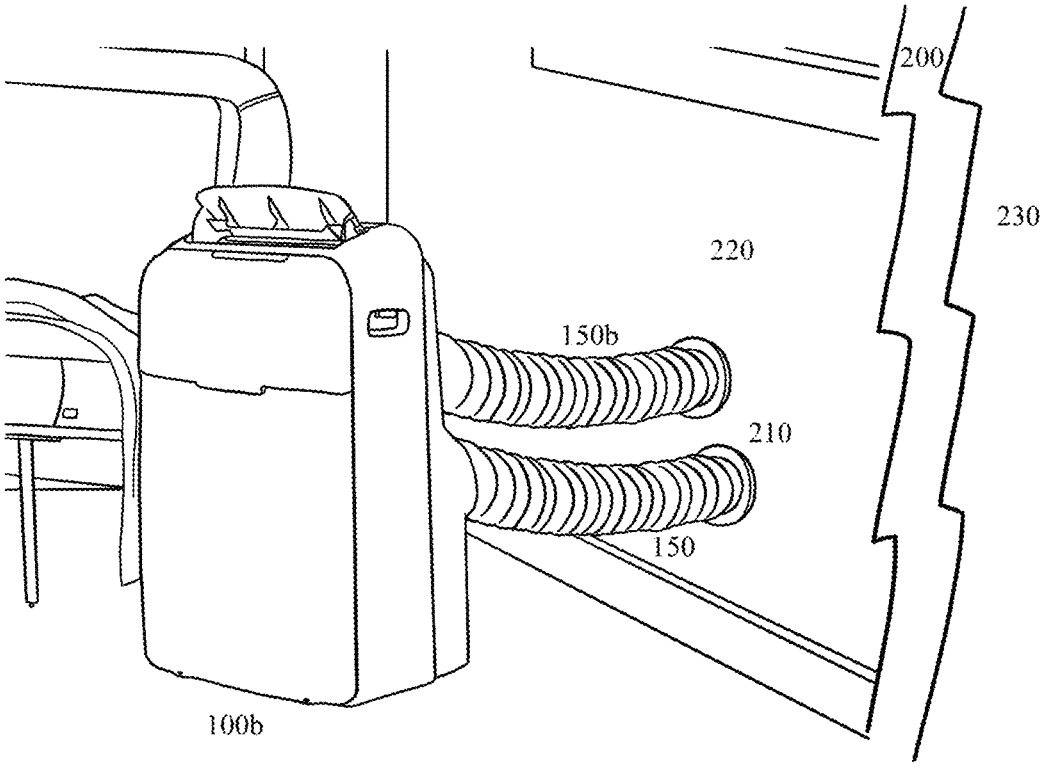
FIG. 4 illustrates the functionality of the exterior wall port connected to a dual-hose portable air conditioning unit.

The functionality of the present invention is exemplified in FIGS. 3 and 4. FIGS. 3-4 illustrate a portable air conditioning unit connected to the present invention shown, in part 210, at an exterior wall 200 of a building. The exterior wall 200 includes an interior side 220 on the inside of the building and an exterior side 230 at the outside of the building, the interior side and the exterior side spatially disposed with respect to one another. In FIG. 3, the present invention creates a sealed pathway through the building's exterior wall 200 whereby the vent hose 150 of the unit 100 is connected to the wall port 210 at the interior side 220 of the wall. FIG. 4 illustrates a dual-hose unit 100*b* connected to the present invention, wherein a sealed pathway is created through the building's exterior wall 200 whereby the vent hose 150 of the unit 100*b* and an air intake hose 150*b* are connected to the wall ports 210 at the interior side 220 of the wall.

Figure 5:
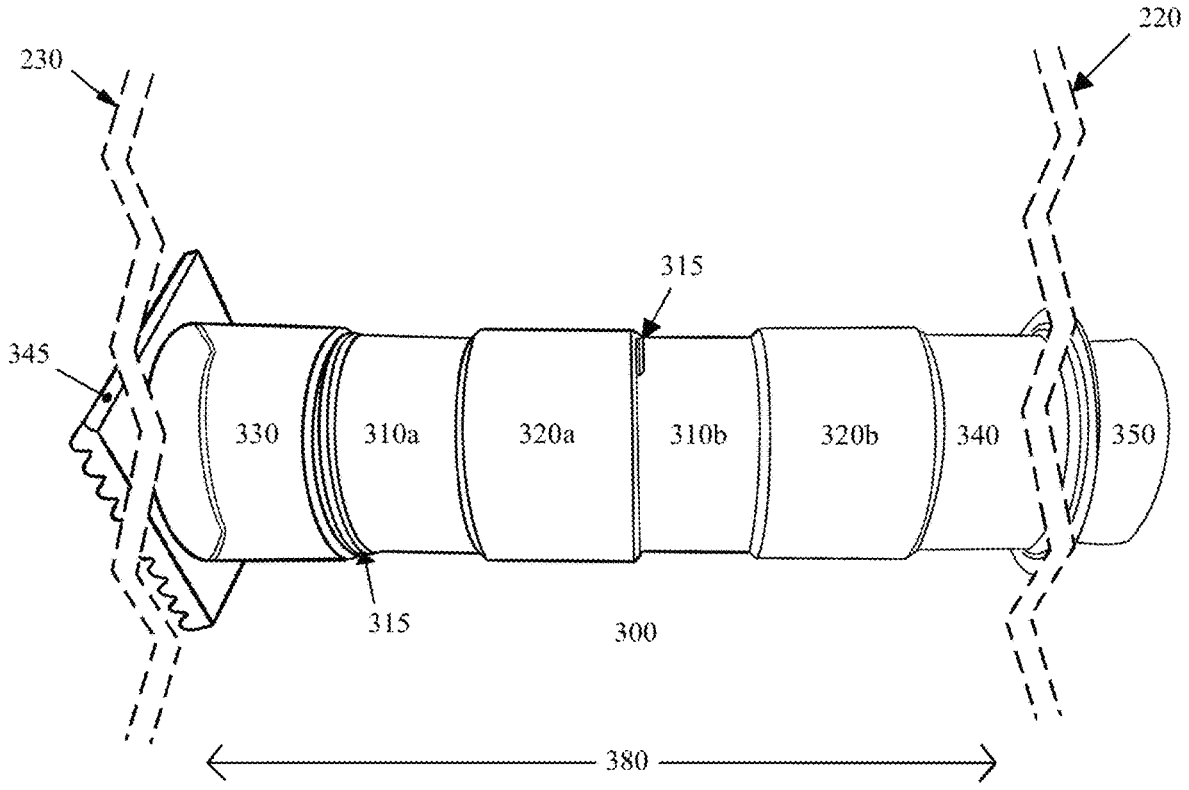
FIG. 5 illustrates sleeve components of the exterior wall port, connected to fittings at opposite ends.
Figure 6:
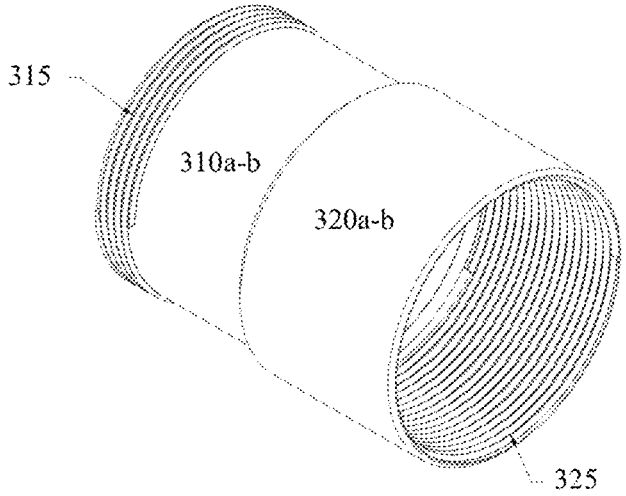
FIG. 6 illustrates the inner and outer sleeves.

As illustrated in FIG. 5, within the interior of the building wall 200 of the building, the present invention comprises multiple cylindrical inner sleeves 310*a-b* and outer sleeves 320*a-b* coupled to an exterior port fitting 330 on one end and an interior port fitting 340 on the opposite end. The dimensions of the sleeves and the number of combined sleeves are determined by the distance of the pathway 380 within the interior of the building wall between the interior side 220 and the exterior side 230. Any number of sleeves can be combined to accommodate any wall thickness. The sleeves are coupled together by threading or clamped fittings to create a securely sealed pathway 300 through the building wall 200. Shown in FIGS. 5 and 6, the inner sleeves 310*a-b* have external threading 315, and the outer sleeves 320*a-b* have internal threading 325, allowing the components to create a secure seal. Alternatively, the sleeves may contain no threading and coupled together using pressured insertion of sleeve components into one another, with optional clamping or adhesive. The length of the wall port may also be adjusted by manipulating the threading or the insertion of the sleeve components to extend or diminish the combined length of the port through the interior of the wall.

Figure 7:
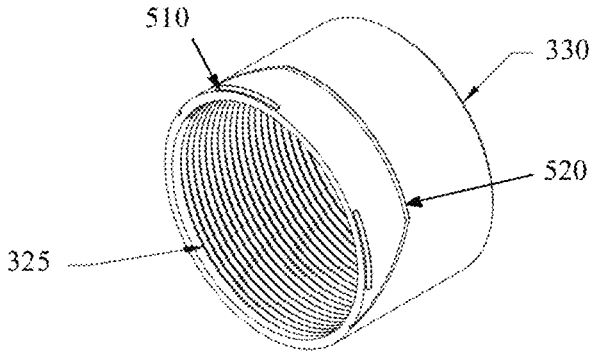
FIG. 7 illustrates details of the exterior port fitting.

As shown in FIG. 5, the inner sleeve 310*a* is coupled to one end of the exterior port fitting 330 on the interior of the building wall, wherein the opposite end of the exterior port fitting 330 is coupled to a louvered cover plate 345 positioned flush with the exterior side wall 230. FIG. 7 illustrates details of the external port fitting 330, having internal threading 325 throughout the entire inner length to enable interlocked coupling with the inner sleeve 310*a*. At the opposite end, in addition to the internal threading, the fitting also has multiple twist lock protrusions 510 at the outermost edge and a water drainage groove 520 at the outer side of the circumference to allow for drainage of any condensation buildup. The preferred embodiment of this component has three twist lock protrusions 510. However, the number of protrusions needed to establish a secure lock depends, in part, on the length of the protrusions. The preferred embodiment also comprises a water drainage groove 520 that extends across the upper side of the exterior port fitting, with each end of the groove running at a downward diagonal to terminate at the outer edges of the fitting. Notwithstanding, the groove may take on any traverse across the top of the fitting that would effectively allow for drainage.

Figure 8:
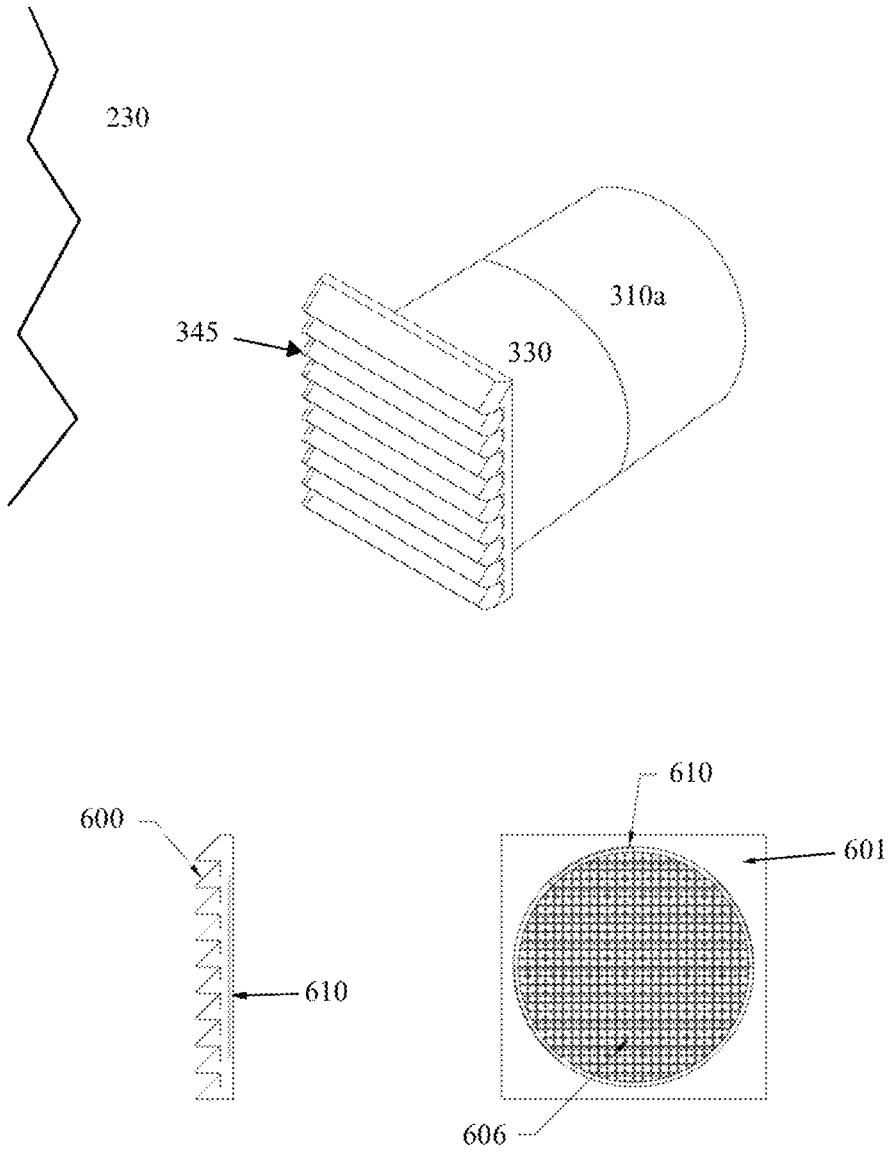
FIG. 8 illustrates details of the louvered cover plate.

FIG. 8 illustrates details of the louvered cover plate 345 positioned at the exterior side 230 of the building wall. Although the louvered cover plate can be of any geometrical shape, the preferred embodiment of the outer facing plate is square, with downward positioned, horizontal louvers 600 that direct rainfall away from the wall port. The back side 601 of the cover plate 345 has a circularly shaped interior ridge with twist lock grooves 610 at the inner edge of the ridge that interlock with the twist lock protrusions 510 of the exterior port fitting 330 as the exterior port fitting is twisted into the backside of the cover plate. The circular area is covered with a mesh grating 606 to prevent dust, debris, and insects from entering the wall port.

Figure 9:
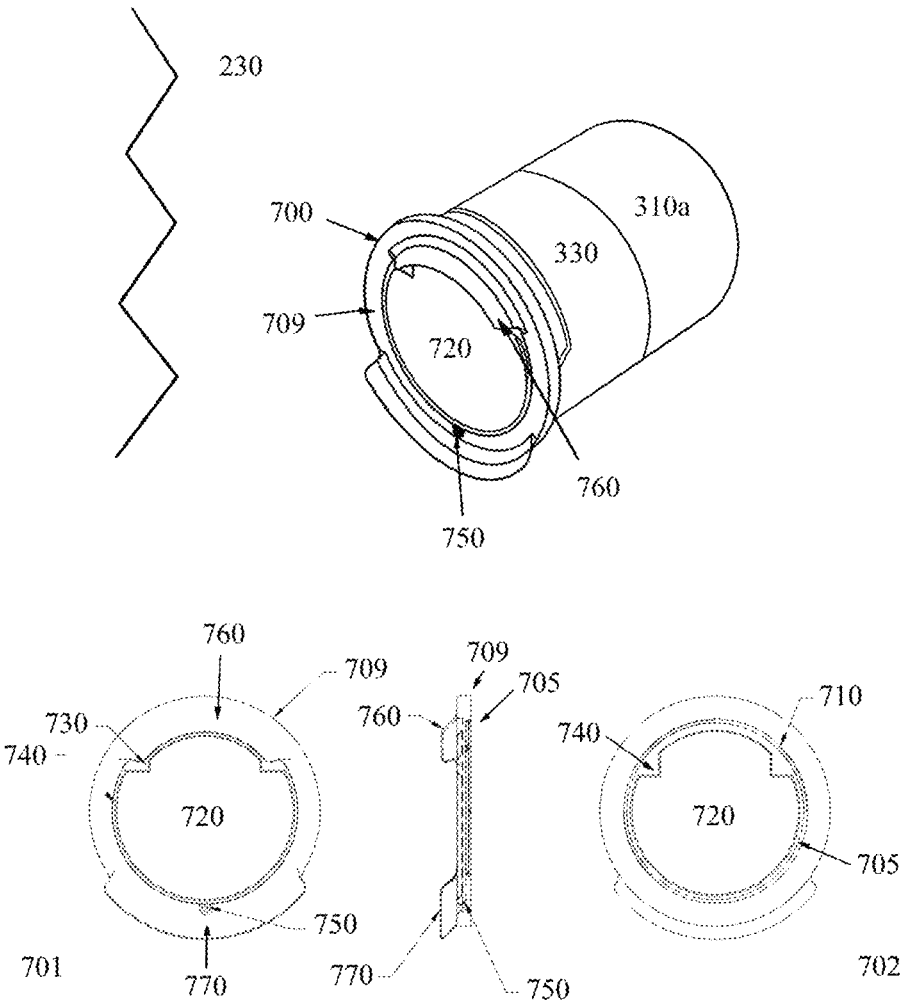
FIG. 9 illustrates details of the exterior vent cap.

As an alternative selection to the louvered cover plate, the exterior wall port can be covered with an exterior vent cap 700 that is positioned flush with the exterior side wall 230, as shown in FIG. 9. The inner sleeve 310*a* is coupled to the exterior port fitting 330, which is coupled to the vent cap 700. The vent cap is circular to coincide with circular exterior fitting, comprising an exterior port flange 709 on the outer facing front side 701 at the outer rim of the component that abuts the exterior side wall 230, securing the position of the component against the building. The component 700 comprises a vent flap 720 at the interior of the flange 709 and coinciding in area with the opening through the pathway. The vent flap 720 comprises two hinges 730 near the top of the flange 709, enabling the flap 720 to pivot freely between an open and closed position. The vent cap also comprises a damper 740 around the opening of the flap and a weep hole 750 near the bottom of the flange. The outer facing flange is also shaped with an integral downward curved hood 760 protruding at the top of the flange to direct rainfall away from the vent flap 720. Further, the flange has an integral downward sloped protrusion at the bottom that forms a drip guard 770 to direct rain and condensation away from the building. The weep hole 750 is positioned above the drip guard 770 so that the drip guard catches and redirects any condensation formed during the cooling process. The back side 702 of the vent cap 230 has an integral circular ridge 705 with twist lock grooves 710 at the interior that interlocks with the twist lock protrusions 510 of the exterior port fitting 330 as the exterior port fitting is twisted into the backside of the vent cap.

Figure 10:
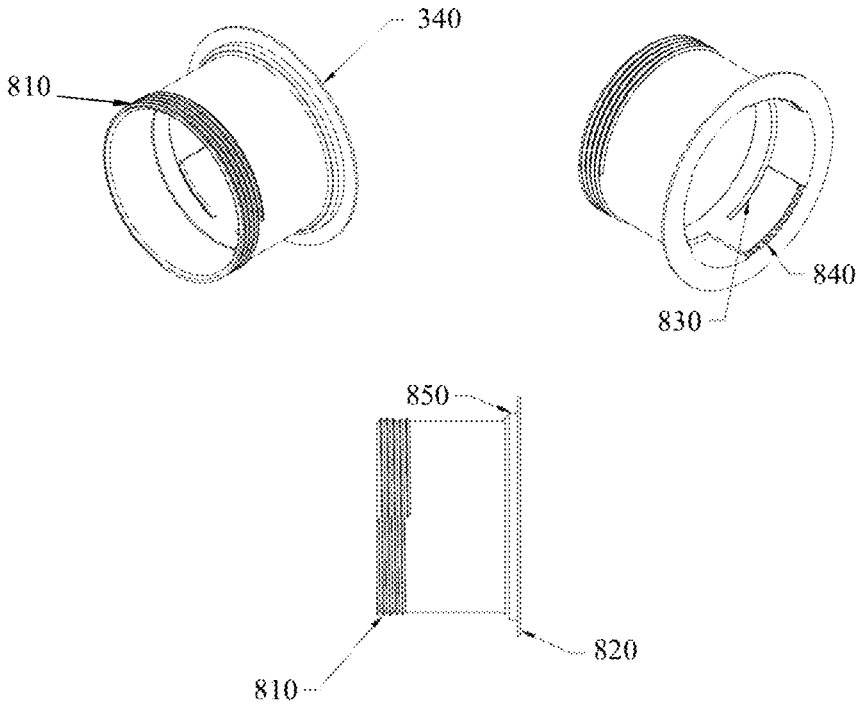
FIG. 10 illustrates details of the interior port fitting.

As illustrated in FIG. 5, the outer sleeve 320*b* is coupled to one end of the interior port fitting 340 on the interior of the building wall, wherein the opposite end of the interior port fitting is coupled to an interior hose adapter 350. FIG. 10 illustrates details of the interior port fitting, wherein the fitting 340 has exterior threading 810 to enable interlocking with the outer sleeve 320*b*. At the opposite end to the threading, the interior port fitting comprises an outer flange 820 that is flush with the outer side of the interior side wall 220 with a hole centering ring 850. Also opposite the threading, on the interior of the port fitting are multiple twist lock grooves 830 and ratcheting teeth 840 to facilitate a secure connection with the coupling components.

Figure 11:
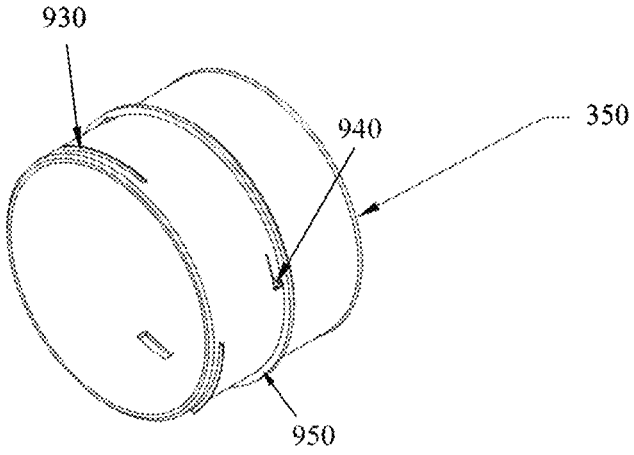
FIG. 11 illustrates details of the interior hose adapter.
Figure 11:
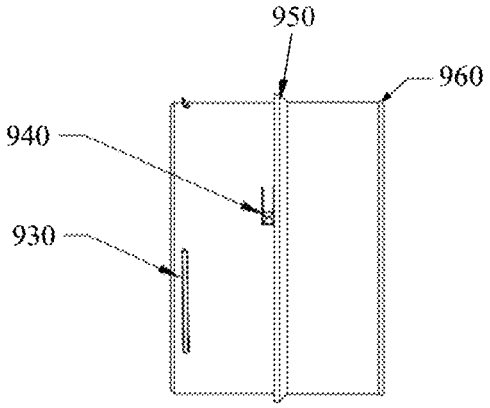
Figure 12:
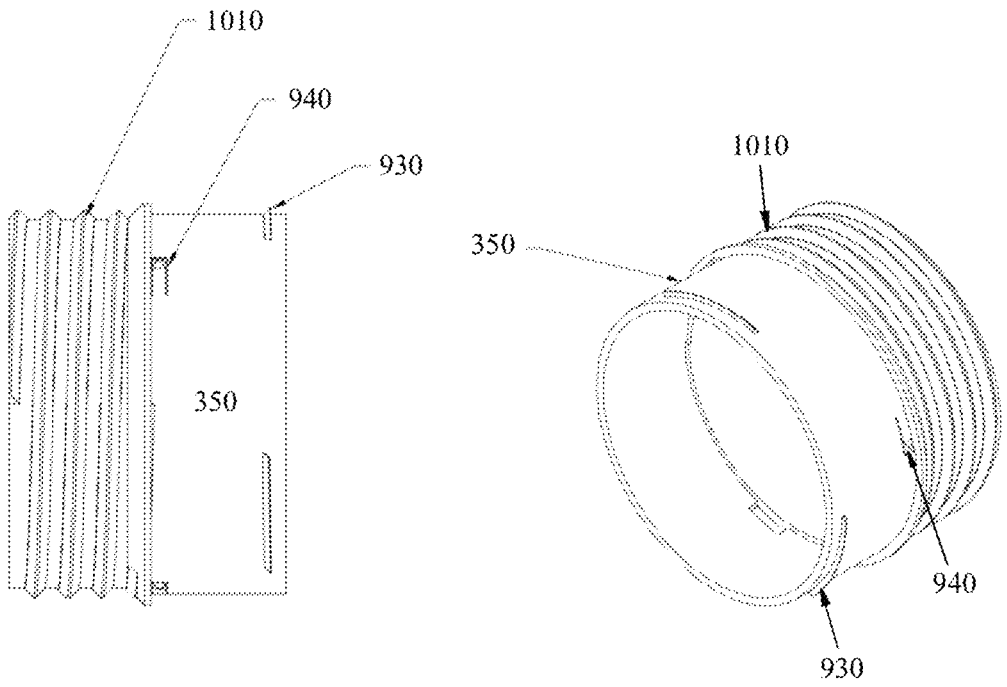
FIG. 12 illustrates details of another embodiment of the interior hose adapter.

FIG. 11 illustrates details of the interior hose adapter 350. The interior hose adapter is an optional connection that interlocks into the interior port fitting 340 (shown in FIG. 5). The locking side has multiple twist lock protrusions 930 that coincide with the grooves 830 of the interior port fitting 340 (see FIG. 10) and ratcheting tabs 940 near the center of the adapter that coincide to facilitate locking with the ratcheting teeth 840 of the interior port fitting. At the center of the adapter is a centering ring 950 that stabilizes positioning into the interior port fitting 340. On the opposite end from the twist lock protrusions and ratcheting tabs, the adapter comprises a hose retaining ridge 960 used for an inserted sleeve connection to the hose of a portable air conditioning unit. As shown in FIG. 12, the interior hose adapter may alternatively comprise exterior hose threads 1010 on the connecting sleeve for a desired connection to a particular hose, while maintaining the other components, including the twist lock protrusions 930 and ratcheting tabs 940 on the opposite end.

Figure 13:
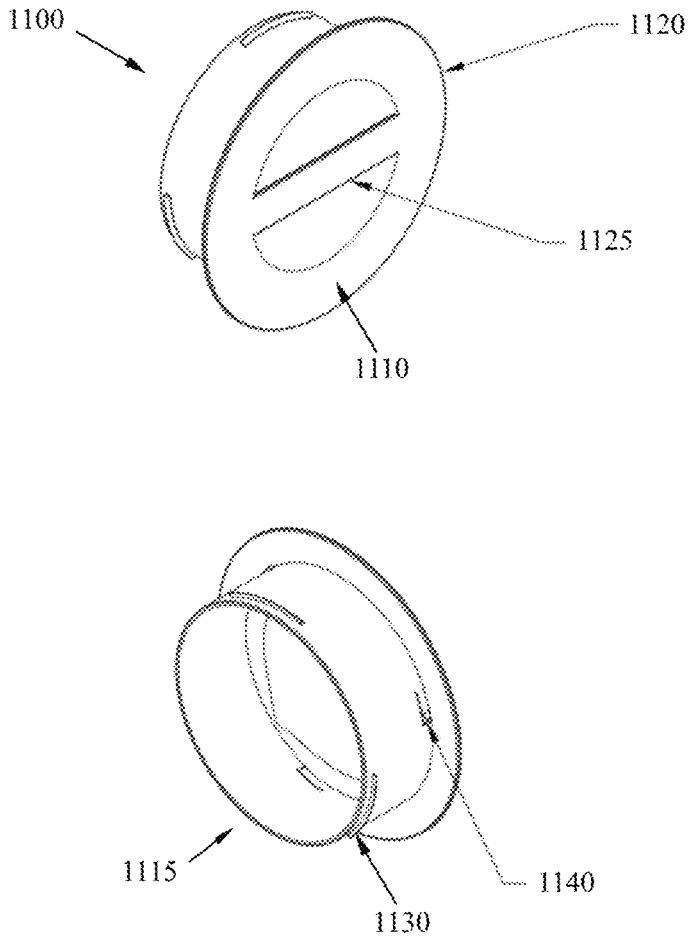
FIG. 13 illustrates details of the interior port cap.

For those times when the air conditioning unit is not in use, the interior hose adapter may be detached and replaced with an interior port cap to cover the port opening. FIG. 13 shows details of the interior port cap 1100, wherein the circular cap is sized slide into the interior port fitting, with an outer face 1110 that comprises a flange 1120 that extends over the interior port fitting and is positioned flush with the interior side of the interior wall of the building. The outer face 1110 further comprises a handle 1125 across the face to enable manipulation of the cap. The open back side 1115 of the cap comprises multiple twist lock protrusions 1130 that coincide with the grooves 830 of the interior port fitting and ratchet tabs 1140 coinciding with the ratcheting teeth 840 of the interior port fitting to provide for an interlocking connection between the interior port cap and the interior port fitting.

Figure 14:
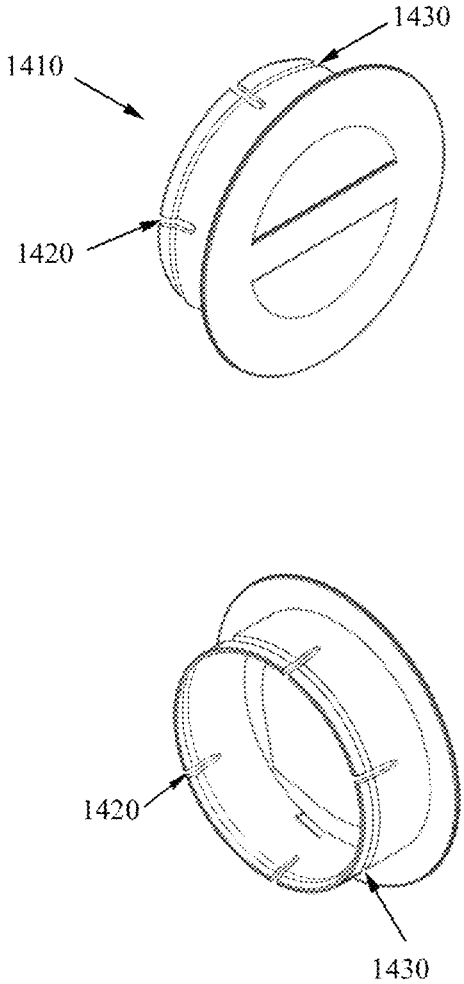
FIG. 14 illustrates an end component (interior port cap) with a snap connection.

As an alternative to the threading and the twist lock and ratchet closures used for coupling the end components to the port fittings, snap grooves formed by vertical cutouts through the end components may be used to facilitate a quick connection. FIG. 14 illustrates an end component 1410 (interior port cap) with vertical cutouts 1420 in the cylindrical sleeve and an indentation ring 1430 at the back side of the component. The cutouts allow for a quick snap coupling of components by pressure fitting the components together to achieve a secure connection.

Figure 15:
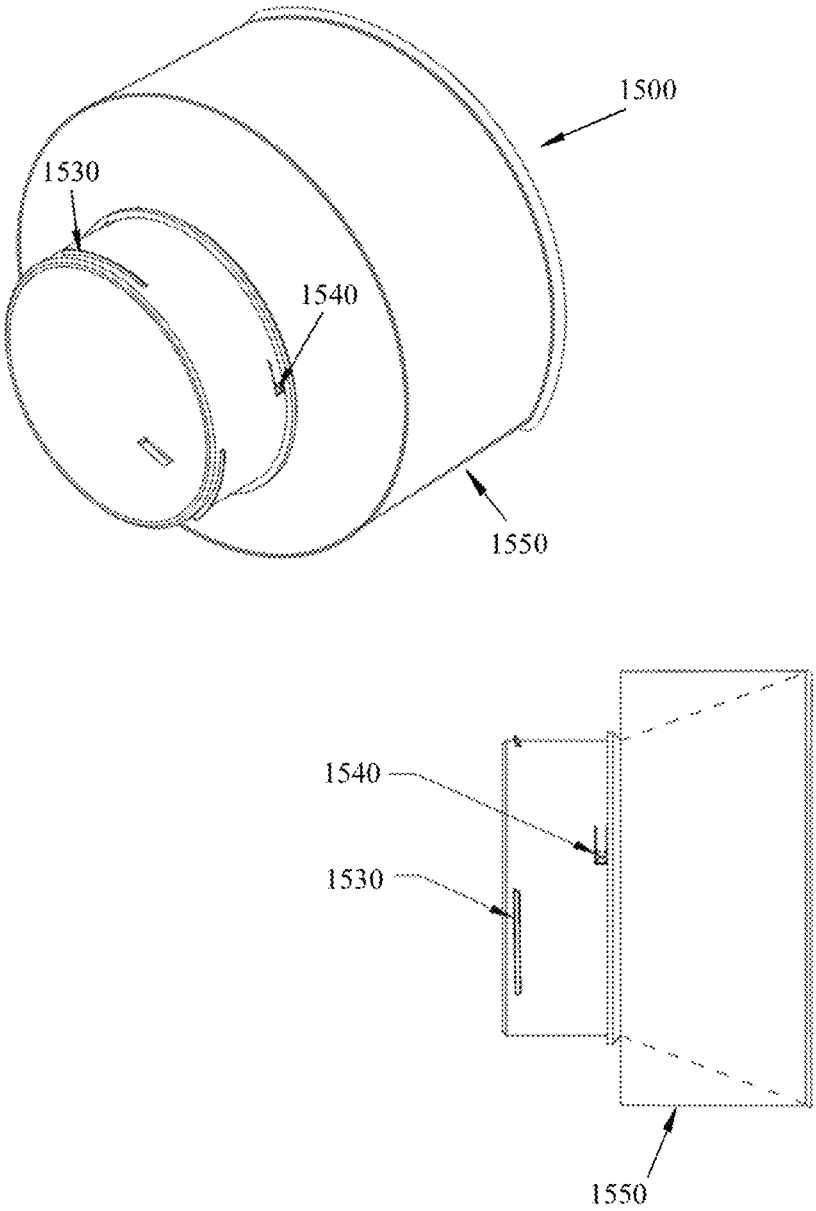
FIG. 15 illustrates an adapter that augments the port fitting.
Figure 16:
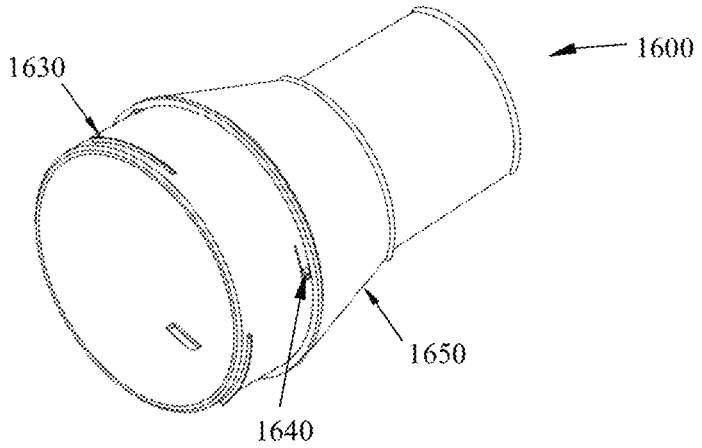
FIG. 16 illustrates an adapter that reduces the port fitting.
Figure 16:
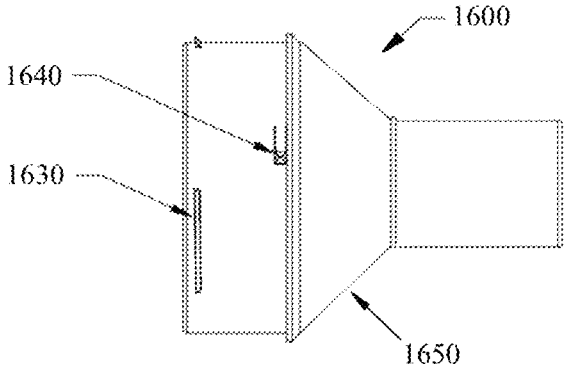

Because hoses of portable air conditioning units come in various sizes, an optional sizing adapter may be used to size up or size down for connection to a desired hose. FIG. 15 illustrates a sizing adapter 1500 that augments the port fitting to fit a larger diameter hose, wherein the adapter connects to the interior port fitting. The adapter has a cylindrical locking side that connects to the interior port fitting and an adapter side to fit the desired larger hose size. The interior locking side has multiple twist lock protrusions 1530 that coincide with the grooves 830 of the interior port fitting 340 (see FIG. 10) and ratcheting tabs 1540 near the center of the adapter that coincide to facilitate locking with the ratcheting teeth 840 of the interior port fitting. The adapter side widens to augment 1550 in diameter to provide a secure fitting for the air conditioner hose. Conversely, a sizing adapter may be used to reduce the port fitting to fit a smaller diameter hose as shown in FIG. 16. The sizing adapter 1600 has a cylindrical locking end that connects to the interior port fitting. The cylindrical locking end transitions to an opposite sleeve end that provides a connection sized to fit a smaller hose. The interior locking end has multiple twist lock protrusions 1630 that coincide with the grooves 830 of the interior port fitting 340 (see FIG. 10) and ratcheting tabs 1640 near the center of the adapter that coincide to interlock with the ratcheting teeth 840 of the interior port fitting when the sizing adapter slides into the interior port fitting. There is a transition between the locking end and the sleeve end that reduces in diameter such that the diameter of the locking end is larger than the diameter of the sleeve end. The sleeve end must be long enough to enable a secure connection with a vent hose of an air conditioning unit. Both an augmenting adapter and a reducing adapter are optional for use with varying hose sizes of a portable air conditioning unit.

The present invention provides a viable solution to the need for creating a secure pathway from a portable air conditioning unit through a building wall (see FIGS. 3-5). The exterior wall port described herein enables efficient operation and increased energy efficiency of single-hose and dual-hose portable air conditioning units of any size. Various embodiments of the present invention may be determined by the specific dimensions of the building and the aesthetic view of the interior and exterior desired. While particular embodiments of this invention have been illustrated in the figures and described herein, it will be apparent that many changes may be made in the dimensions, composition, form, arrangement, and positioning of the numerous elements of this apparatus. In consideration thereof, it should be understood that the various embodiments of this invention described in full or in part are intended to be illustrative only and not intended to limit the scope of this invention.

The invention claimed is:

1. An exterior wall port apparatus to support a vent hose of a portable air conditioning unit, said apparatus comprising:

an exterior port fitting having a cylindrical hollow shape having a first end, a second end, an inside surface area, and an outside surface area, said first end having an outermost edge and a top side, wherein said first end comprises at least one twist lock protrusion at said outermost edge and a water groove that traverses said top side and terminates at opposing lower points of said first end;

an interior port fitting having a cylindrical hollow shape coinciding in size to tightly fit inside said exterior port fitting, said interior port fitting having a first end, a second end, an inside surface area, and an outside surface area, wherein said first end of said interior port fitting is coupled to said second end of said exterior port fitting, wherein said second end of said interior port fitting comprises a first stabilizing flange and wherein said second end of interior port further comprises at least one twist lock groove and a set of ratcheting teeth, both disposed on said inner surface area;

an interior hose adapter having a cylindrical hollow shape coinciding in size to tightly fit inside said interior port fitting, said interior hose adapter having a first end, a second end, an inside surface area, and an outside surface area, wherein said first end of said interior hose adapter is configured at the outside surface area to comprise at least one twist lock protrusion and a set of ratcheting tabs, said interior hose adapter further comprising a second stabilizing flange centrally disposed about said outer surface area;

wherein said first end of said interior hose adapter slides into said second end of said interior port fitting such that said at least one twist lock protrusion and said set of ratcheting tabs of said interior hose adapter interlock with said at least one twist lock groove and said set of ratcheting teeth of said interior port fitting; and wherein said first end of said exterior port fitting is coupled to either a louvered cover plate or an exterior vent cap;

said louvered cover plate having a frontside and a backside, wherein said frontside comprises multiple downward-positioned horizontal louvers, and wherein said backside comprises a circular area coinciding in size with said cylindrical hollow shape of said exterior port fitting, said circular area comprising a circular interior ridge having at least one twist lock groove and a mesh grating covering said circular area;

said exterior vent cap comprising:

an exterior port flange having a larger diameter than said exterior port fitting, an integral downward-curved rain hood at an outer top portion of said exterior port flange, an integral downward-sloped drip guard at an outer bottom portion of said exterior port flange, with a weep hole above said drip guard, two hinges opposingly disposed near an upper portion of said exterior port flange, a centrally disposed vent flap with a circular opening coinciding with said cylindrical hollow shape of said exterior port fitting, said two hinges pivotally coupled to said vent flap, a damper disposed around said circular opening of said vent flap, and a backside with an integral circular ridge with at least one twist lock groove; and wherein said first end of said exterior port fitting is inserted into either said backside of said louvered plate cover or said backside of said exterior vent cap, such that at least one twist lock protrusion of said exterior port fitting interlocks with either said at least one twist lock groove of said louvered cover plate or said at least one twist lock groove of said exterior vent cap.

2. The exterior wall port apparatus to support the vent hose of the portable air conditioning unit as recited in claim 1, wherein said exterior port fitting additionally comprises interior threading, said interior port fitting additionally comprises exterior threading, and said exterior port fitting is threadingly interlocked to said interior port fitting.

3. The exterior wall port apparatus to support the vent hose of the portable air conditioning unit as recited in claim 2, further comprising an inner sleeve with exterior threading and an outer sleeve with interior threading, wherein a first end of said inner sleeve threadingly coupled into a first end of said outer sleeve, a second end of said inner sleeve threadingly coupled into said second end of said exterior port fitting, and a second end of said outer sleeve threadingly coupled over said first end of said interior port fitting.

4. The exterior wall port apparatus to support the vent hose of the portable air conditioning unit as recited in claim 3, further comprising at least one additional inner sleeve with exterior threading and at least one additional outer sleeve with interior threading, a first end of said at least one additional inner sleeve threadingly coupled into a first end of said at least one additional outer sleeve, said at least one inner sleeve threadingly coupled to said outer sleeve, and said at least one outer sleeve threadingly coupled to said inner sleeve.

5. The exterior wall port apparatus to support the vent hose of the portable air conditioning unit as recited in claim 1, wherein said louvered cover plate is square.

6. The exterior wall port apparatus to support the vent hose of the portable air conditioning unit as recited in claim 1, wherein said interlock of said at least one twist lock protrusion and said set of ratcheting tabs of said interior hose adapter with said at least one twist lock groove and said set of ratcheting teeth of said interior port fitting is replaced with a snapping configuration.

7. An exterior wall port apparatus to support a vent hose of a portable air conditioning unit, said apparatus comprising:

an exterior port fitting having a cylindrical hollow shape having a first end, a second end, an inside surface area, and an outside surface area, said first end having an outermost edge and a top side, wherein said first end comprises at least one twist lock protrusion at said outermost edge and a water groove that traverses said top side and terminates at opposing lower points of said first end;

an interior port fitting having a cylindrical hollow shape coinciding in size to tightly fit inside said exterior port fitting, said interior port fitting having a first end, a second end, an inside surface area, and an outside surface area, wherein said first end of said interior port fitting is coupled to said second end of said exterior port fitting, wherein said second end of said interior port fitting comprises a first stabilizing flange and wherein said second end of interior port further comprises at least one twist lock groove and a set of ratcheting teeth, both disposed on said inner surface area;

an interior port cap having a circular shape with an outer front face coinciding in size with said interior port fitting and a backside, said interior port cap comprising:

a flange that extends over said interior port fitting, a handle extending across said outer front face, at least one twist lock protrusion and a set of ratcheting tabs positioned at said backside;

wherein said interior port cap slides into said interior port fitting such that said at least one twist lock protrusion and set of ratcheting tabs of said interior port cap interlocks with said at least one twist lock groove and said set of ratcheting teeth of said interior port fitting; and wherein said first end of said exterior port fitting is coupled to either a louvered cover plate or an exterior vent cap;

said louvered cover plate having a frontside and a backside, wherein said frontside comprises multiple downward-positioned horizontal louvers, and wherein said backside comprises a circular area coinciding in size with said cylindrical hollow shape of said exterior port fitting, said circular area comprising a circular interior ridge having at least one twist lock groove and a mesh grating covering said circular area;

said exterior vent cap comprising:

an exterior port flange having a larger diameter than said exterior port fitting, an integral downward-curved rain hood at an outer top portion of said exterior port flange, an integral downward-sloped drip guard at an outer bottom portion of said exterior port flange, with a weep hole above said drip guard, two hinges opposingly disposed near an upper portion of said exterior port flange, a centrally disposed vent flap with a circular opening coinciding with said cylindrical hollow shape of said exterior port fitting, said two hinges pivotally coupled to said vent flap, a damper disposed around said circular opening of said vent flap, and a backside with an integral circular ridge with at least one twist lock groove; and wherein said first end of said exterior port fitting is inserted into either said backside of said louvered plate cover or said backside of said exterior vent cap, such that at least one twist lock protrusion of said exterior port fitting interlocks with either said at least one twist lock groove of said louvered cover plate or said at least one twist lock groove of said exterior vent cap.

8. The exterior wall port apparatus to support the vent hose of the portable air conditioning unit as recited in claim 7, wherein said exterior port fitting additionally comprises interior threading, said interior port fitting additionally comprises exterior threading, and said exterior port fitting is threadingly interlocked to said interior port fitting.

9. The exterior wall port apparatus to support the vent hose of the portable air conditioning unit as recited in claim 8, further comprising an inner sleeve with exterior threading and an outer sleeve with interior threading, wherein a first end of said inner sleeve threadingly coupled into a first end of said outer sleeve, a second end of said inner sleeve threadingly coupled into said second end of said exterior port fitting, and a second end of said outer sleeve threadingly coupled over said first end of said interior port fitting.

10. The exterior wall port apparatus to support the vent hose of the portable air conditioning unit as recited in claim 9, further comprising at least one additional inner sleeve with exterior threading and at least one additional outer sleeve with interior threading, a first end of said at least one additional inner sleeve threadingly coupled into a first end of said at least one additional outer sleeve, said at least one inner sleeve threadingly coupled to said outer sleeve, and said at least one outer sleeve threadingly coupled to said inner sleeve.

11. The exterior wall port apparatus to support the vent hose of the portable air conditioning unit as recited in claim 7, wherein said louvered cover plate is square.

12. The exterior wall port apparatus to support the vent hose of the portable air conditioning unit as recited in claim 7, wherein said interlock of said at least one twist lock protrusion and said set of ratcheting tabs of said interior port cap with said at least one twist lock groove and said set of ratcheting teeth of said interior port fitting is replaced with a snapping configuration.

13. An exterior wall port apparatus to support a vent hose of a portable air conditioning unit, said apparatus comprising:

an exterior port fitting having a cylindrical hollow shape having a first end, a second end, an inside surface area, and an outside surface area, said first end having an outermost edge and a top side, wherein said first end comprises at least one twist lock protrusion at said outermost edge and a water groove that traverses said top side and terminates at opposing lower points of said first end;

an interior port fitting having a cylindrical hollow shape coinciding in size to tightly fit inside said exterior port fitting, said interior port fitting having a first end, a second end, an inside surface area, and an outside surface area, wherein said first end of said interior port fitting is coupled to said second end of said exterior port fitting, wherein said second end of said interior port fitting comprises a first stabilizing flange and wherein said second end of interior port further comprises at least one twist lock groove and a set of ratcheting teeth, both disposed on said inner surface area;

a sizing adapter having a circular hollow shape with a first end and a second end, said first end coinciding in size to tightly fit inside said interior port fitting and comprising at least one twist lock protrusion and a set of ratcheting tabs, and said second end sized to fit either a larger vent hose or a smaller vent hose, wherein said first end of said sizing adapter slides into said second end of said interior port fitting such that said at least one twist lock protrusion and said set of ratcheting tabs of said sizing adapter interlock with said at least one twist lock groove and said set of ratcheting teeth of said interior port fitting; and wherein said first end of said exterior port fitting is coupled to either a louvered cover plate or an exterior vent cap;

said louvered cover plate having a frontside and a backside, wherein said frontside comprises multiple downward-positioned horizontal louvers, and wherein said backside comprises a circular area coinciding in size with said cylindrical hollow shape of said exterior port fitting, said circular area comprising a circular interior ridge having at least one twist lock groove and a mesh grating covering said circular area;

said exterior vent cap comprising:

an exterior port flange having a larger diameter than said exterior port fitting, an integral downward-curved rain hood at an outer top portion of said exterior port flange, an integral downward-sloped drip guard at an outer bottom portion of said exterior port flange, with a weep hole above said drip guard, two hinges opposingly disposed near an upper portion of said exterior port flange, a centrally disposed vent flap with a circular opening coinciding with said cylindrical hollow shape of said exterior port fitting, said two hinges pivotally coupled to said vent flap, a damper disposed around said circular opening of said vent flap, and a backside with an integral circular ridge with at least one twist lock groove; and wherein said first end of said exterior port fitting is inserted into either said backside of said louvered plate cover or said backside of said exterior vent cap, such that at least one twist lock protrusion of said exterior port fitting interlocks with either said at least one twist lock groove of said louvered cover plate or said at least one twist lock groove of said exterior vent cap.

14. The exterior wall port apparatus to support the vent hose of the portable air conditioning unit as recited in claim 13, wherein said exterior port fitting additionally comprises interior threading, said interior port fitting additionally comprises exterior threading, and said exterior port fitting is threadingly interlocked to said interior port fitting.

15. The exterior wall port apparatus to support the vent hose of the portable air conditioning unit as recited in claim 14, further comprising an inner sleeve with exterior threading and an outer sleeve with interior threading, wherein a first end of said inner sleeve threadingly coupled into a first end of said outer sleeve, a second end of said inner sleeve threadingly coupled into said second end of said exterior port fitting, and a second end of said outer sleeve threadingly coupled over said first end of said interior port fitting.

16. The exterior wall port apparatus to support the vent hose of the portable air conditioning unit as recited in claim 15, further comprising at least one additional inner sleeve with exterior threading and at least one additional outer sleeve with interior threading, a first end of said at least one additional inner sleeve threadingly coupled into a first end of said at least one additional outer sleeve, said at least one inner sleeve threadingly coupled to said outer sleeve, and said at least one outer sleeve threadingly coupled to said inner sleeve.

17. The exterior wall port apparatus to support the vent hose of the portable air conditioning unit as recited in claim 13, wherein said louvered cover plate is square.

18. The exterior wall port apparatus to support the vent hose of the portable air conditioning unit as recited in claim 13, wherein said interlock of said at least one twist lock protrusion and said set of ratcheting tabs of said sizing adapter with said at least one twist lock groove and said set of ratcheting teeth of said interior port fitting is replaced with a snapping configuration.

19. The exterior wall port apparatus to support the vent hose of the portable air conditioning unit as recited in claim 13, wherein said second end of said sizing adapter is larger in diameter than said first end, said second end comprising a cylindrical sleeve coinciding in size with said vent hose.

20. The exterior wall port apparatus to support the vent hose of the portable air conditioning unit as recited in claim 13, wherein said second end of said sizing adapter is smaller in diameter than said first end, said sizing adapter further comprising a transition between said first end and said second end, wherein said transition is configured with a larger end at said first end and a smaller end at said second end, said second end comprising a cylindrical sleeve coinciding in size with said vent hose.

* * * * *